US007690134B2

(12) United States Patent
Kim

(10) Patent No.: US 7,690,134 B2
(45) Date of Patent: Apr. 6, 2010

(54) CUTOFF DEVICE WITH LIQUID BAG

(76) Inventor: Yi-Zoong Kim, 375 Hakmyoung-ri, Kangjin-eub, Kangjin-gun, Junranam-do (KR) 527-806

( * ) Notice: Subject to any disclaimer, the term of this patent is extended or adjusted under 35 U.S.C. 154(b) by 578 days.

(21) Appl. No.: 10/596,064

(22) PCT Filed: Nov. 26, 2004

(86) PCT No.: PCT/KR2004/003084

§ 371 (c)(1),
(2), (4) Date: May 22, 2007

(87) PCT Pub. No.: WO2005/052267

PCT Pub. Date: Jun. 9, 2005

(65) Prior Publication Data

US 2008/0016727 A1 Jan. 24, 2008

(30) Foreign Application Priority Data

Nov. 27, 2003 (KR) ..... 10-2003-0085086

(51) Int. Cl.
*E02F 3/16* (2006.01)
*E02F 3/348* (2006.01)
*E02F 3/24* (2006.01)

(52) U.S. Cl. ..... 37/309; 37/307; 37/317; 37/321; 37/339; 405/226

(58) Field of Classification Search ..... 405/224, 405/226; 37/307, 309, 317, 321, 339; 299/9; 166/356
See application file for complete search history.

(56) References Cited

U.S. PATENT DOCUMENTS 3,862,876 A * 1/1975 Graves ..... 428/83
3,967,458 A * 7/1976 Scales ..... 405/196
4,709,430 A * 12/1987 Nicoll ..... 5/417
4,867,608 A * 9/1989 Kinghorn ..... 405/188

(Continued)

FOREIGN PATENT DOCUMENTS

EP 0047803 9/1980

(Continued)

OTHER PUBLICATIONS

International Search Report for PCT Application No. PCT/KR2004/003084.

*Primary Examiner*—David J Bagnell
*Assistant Examiner*—Nicholas A Wilbur
(74) *Attorney, Agent, or Firm*—Holme Roberts & Owen LLP

(57) ABSTRACT

A cutoff device with a liquid bag includes a framed housing that supports a cover having a cutoff wall. The cutoff wall is opened at a lower end thereof with a liquid bag attached along the opened lower end of the cutoff wall. The housing includes telescopic columns, upper support frames coupled to the upper ends of the telescopic columns, and a lower support frame coupled to the lower ends of the telescopic columns. The upper end of the liquid bag may be fastened to the opened lower end of the cutoff wall using a zipper. The liquid bag contains liquid, such as water, therein, with a heavy substance, such as sand, soil and powdered or granulated metal, added to the liquid.

3 Claims, 5 Drawing Sheets

U.S. PATENT DOCUMENTS 5,389,266 A * 2/1995 Clum et al. ..... 210/747
5,520,364 A * 5/1996 Bloxson et al. ..... 248/500
5,865,564 A 2/1999 Miller et al.
6,209,965 B1 * 4/2001 Borns et al. ..... 299/8
6,216,717 B1 * 4/2001 Chen ..... 135/130
6,517,287 B2 * 2/2003 Zaiger ..... 405/128.25

FOREIGN PATENT DOCUMENTS

JP 63-022909 1/1988
WO 98/44207 10/1998

* cited by examiner

CUTOFF DEVICE WITH LIQUID BAG

CROSS REFERENCE TO RELATED APPLICATIONS

This application claims priority under 35 U.S.C. §119 to Korean Patent Application Serial No. 10-2003-0085086 filed Nov. 27, 2003, and in the national stage of International PCT Application No. PCT/KR2004/003084 filed on Nov. 26, 2004, which are incorporated herein in their entirety by this reference.

TECHNICAL FIELD

The present invention relates, in general, to a cutoff device with a liquid bag and, more particularly, to a cutoff device with a liquid bag, which is configured so that the liquid bag is attached to a lower end of a housing to seal a gap between the cutoff device and a bottom surface contacting the cutoff device, thus preventing fluid from flowing in and out the cutoff device.

BACKGROUND ART

Generally, a fluid cutoff device is configured to prevent water contamination, when sludge is removed from a riverbed using a suction-type dredge. An example of the dredge will be described with reference to FIGS. 1 and 2. As shown in the drawings, the dredge includes a hydraulic pump 2, a vacuum generating unit 3, and a height adjustable ladder 4 that are provided at predetermined positions on a dredger. Further, the dredge includes a suction pipe 5 which is supported by the ladder 4 to vary the depth of the suction pipe 5, and a suction head 6 which is mounted to a lower end of the suction pipe 5. The position and angle of the ladder 4 are adjusted so that the suction head 6 comes into contact with a riverbed 7. A hydraulic hose is coupled to the suction head 6, so that hydraulic pressure is transmitted from the hydraulic pump 2 to the suction head 6. Further, a flow restriction means, namely, a fluid cutoff device is provided at a position around the suction head 6 to vertically move along the suction pipe 5 of the suction-type dredge.

The fluid cutoff device includes a cover 10, a skirt 11, a heavy substance 12, and a rope guide means 20. The cover 10 covers a portion around the suction head 6, and has at a center thereof a pipe guide hole 16 to receive and guide the suction pipe 5. The skirt 11 is mounted to a lower end of the cover 10 and is made of a flexible material. The heavy substance 12 is provided on a lower end of the skirt 11. The rope guide means 20 is integrally provided on an upper surface of the cover 10 to move the cover 10 up and down.

The rope guide means 20 is constructed to guide a rope 21 using a rope drawing motor 22 which is installed at a predetermined position on the dredger, thus winding or unwinding the rope 21.

As shown in FIG. 2, it is preferable that reinforcing ribs 13 be radially provided on the cover 10 at regular intervals, thus increasing the durability of the cover 10. Further, holes 14 are formed on the cover 10 to decrease pressure which is generated during the vertical movement of the cover 10. The cover 10 also includes a ring-shaped support frame 15 to form the pipe guide hole 16.

The conventional cutoff device performs a function of decreasing pressure during the initial downward movement of the cover in dredging work. However, the cutoff device has a problem in that contaminants generated during the dredging work leak out, thus causing environmental contamination.

DISCLOSURE OF THE INVENTION

Accordingly, the present invention has been made keeping in mind the above problems occurring in the prior art, and an object of the present invention is to provide a cutoff device with a liquid bag, capable of preventing the inflow of fluid.

Another object of the present invention is to provide a cutoff device with a liquid bag, which is constructed so that the liquid bag is attached to a lower end of a cutoff wall, thus cutting off the flow of fluid, despite the bottom surface contacting the cutoff device being irregular.

A further object of the present invention is to provide a cutoff device with a liquid bag, which is constructed so that the height of a housing is reduced as the contents of the frame are discharged, thus completely preventing the inlet pressure of fluid from acting on the interior of the cutoff device.

In order to accomplish the above objects, the present invention provides a cutoff device, including a housing which is opened at a bottom thereof, a flexible tubular liquid bag which is provided on a lower end of a cutoff wall constituting a cover seated on the housing, and a heavy substance, such as sand, soil, and powdered or granulated metal, which is added to liquid contained in the liquid bag.

The present invention provides a cutoff device, including a framed housing which is opened at a bottom thereof and supports a cover having a cutoff wall that comprises a wall of the cover, and a flexible liquid bag attached to the lower end of the cutoff wall.

The housing includes telescopic columns that are extensible or compressible, upper support frames coupled to an upper end of the telescopic column, and a lower support frame coupled to lower ends of the telescopic columns.

An outer surface of the cutoff wall of the cover is supported by horizontal support bars that are arranged at regular heights.

The lower end of the cutoff wall is fastened to the upper end of the liquid bag using a zipper.

DESCRIPTION OF REFERENCE CHARACTERS OF IMPORTANT PARTS

Figure 1:
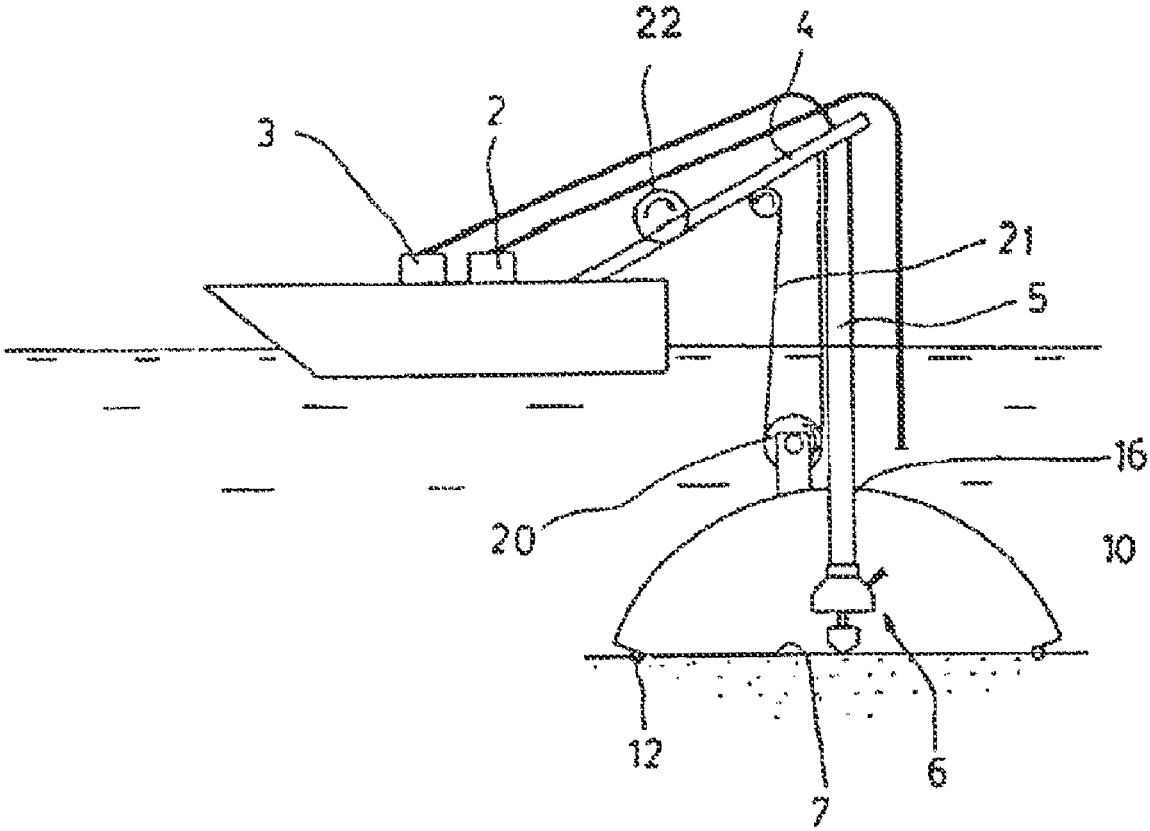
Prior Art Fig.1
FIG. 1 is a view illustrating the construction of a conventional cutoff device.
Figure 2:
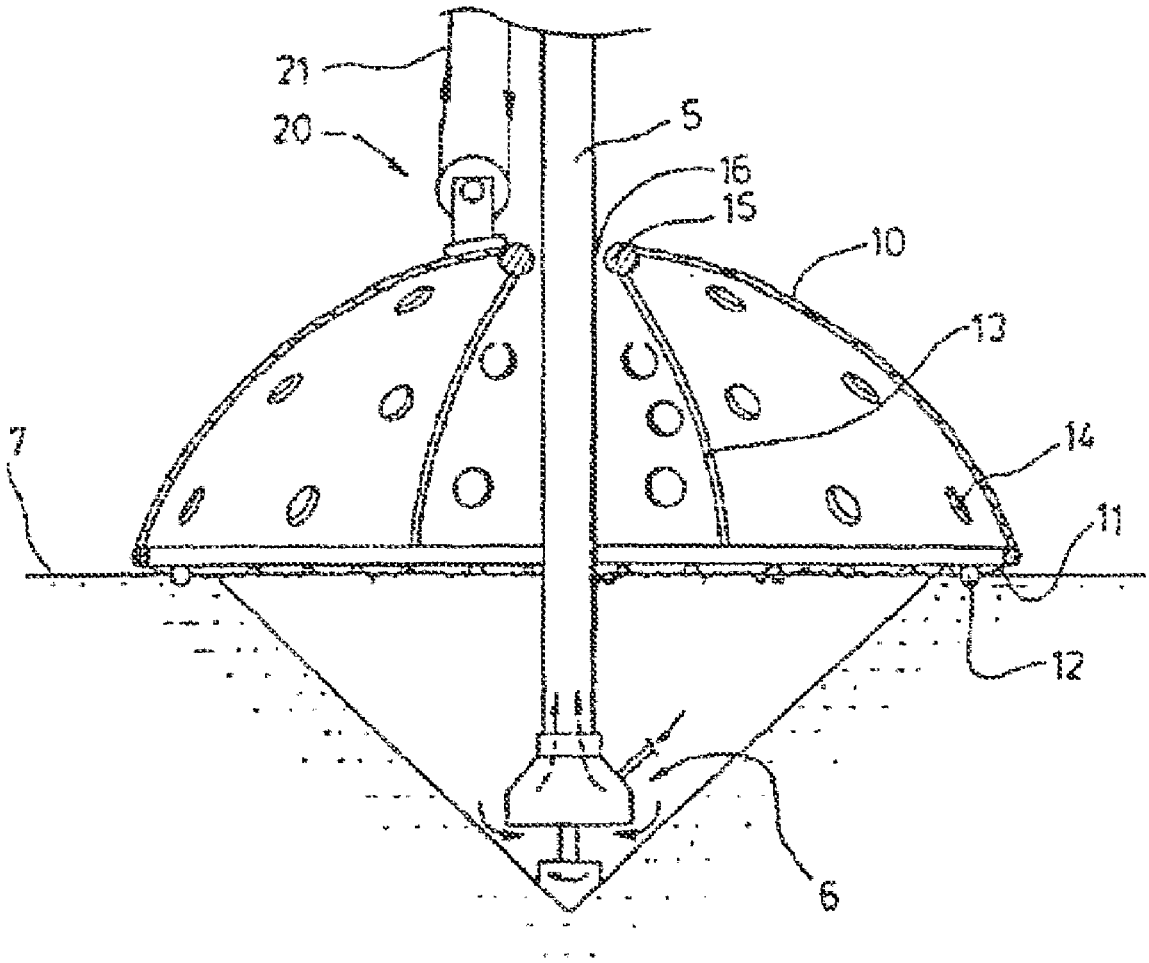
Prior Art Fig.2
FIG. 2 is an enlarged sectional view to show a cover of the cutoff device of FIG. 1.

30; housing 31; cutoff wall 32; inner frame 33; cover 35; telescopic columns 36; upper support frames 37; lower support frame 38; horizontal support bars 39; zipper 40; liquid bag 50; heavy substance

BEST MODE FOR CARRYING OUT THE INVENTION

This invention will be described in detail by way of example with reference to the accompanying drawings.

Figure 3:
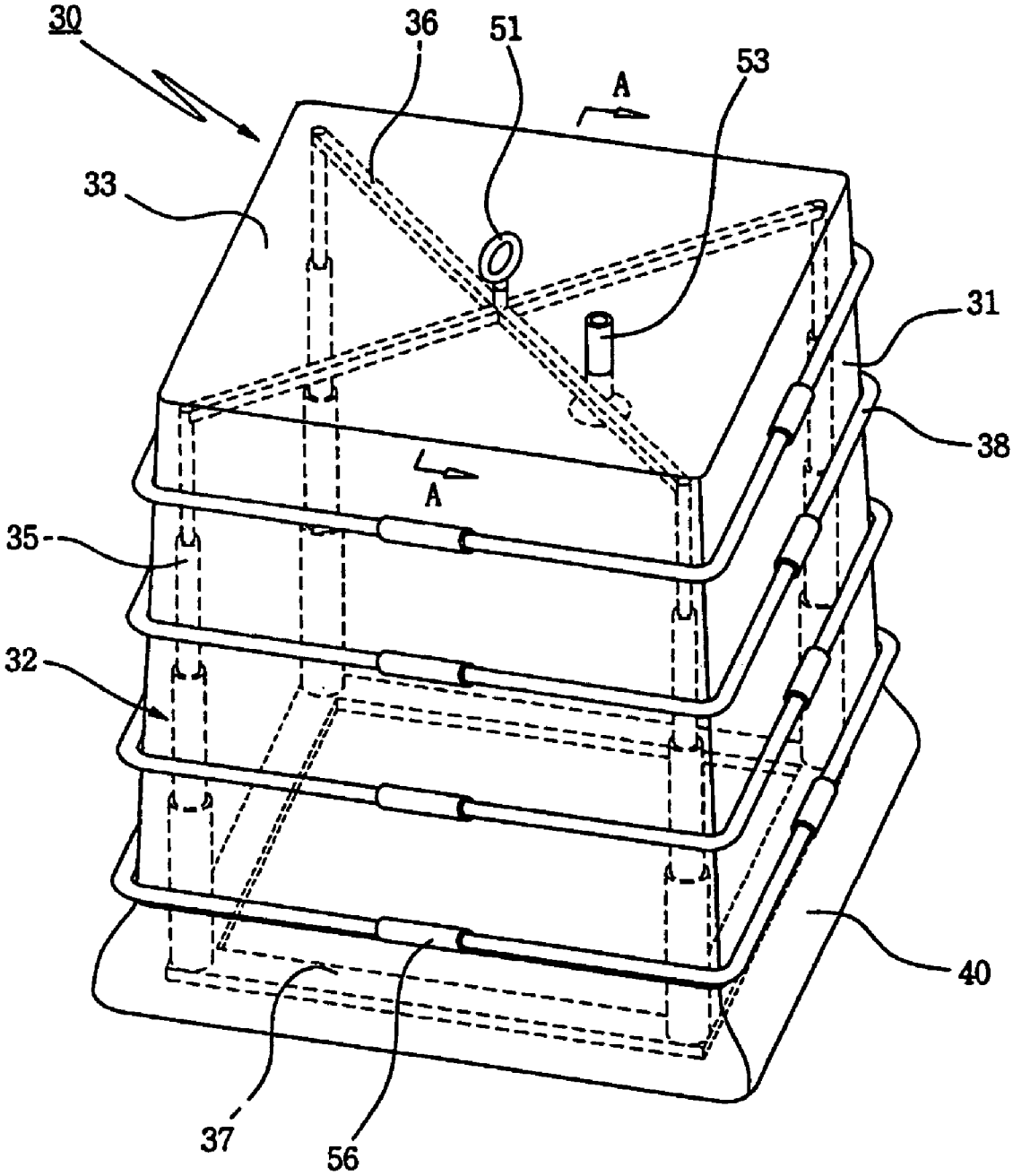
FIG. 3 is a perspective view of a cutoff device, according to the present invention.

FIG. 3 is a perspective view of a cutoff device, according to the present invention. The cutoff device includes telescopic columns 35. Upper support frames 36 are coupled to upper ends of the telescopic columns 35, and a lower support frame 37 is coupled to lower ends of the telescopic columns 35. A waterproof flexible cover 33 is provided to cover sides of the telescopic columns 35 and upper surfaces of the upper support frames 36. The telescopic columns 35 and the upper and lower support frames 37 constitute a framed housing. Of course, if each telescopic column 35 is not high, a column having a fixed length may be used in place of the telescopic structure.

Figure 4:
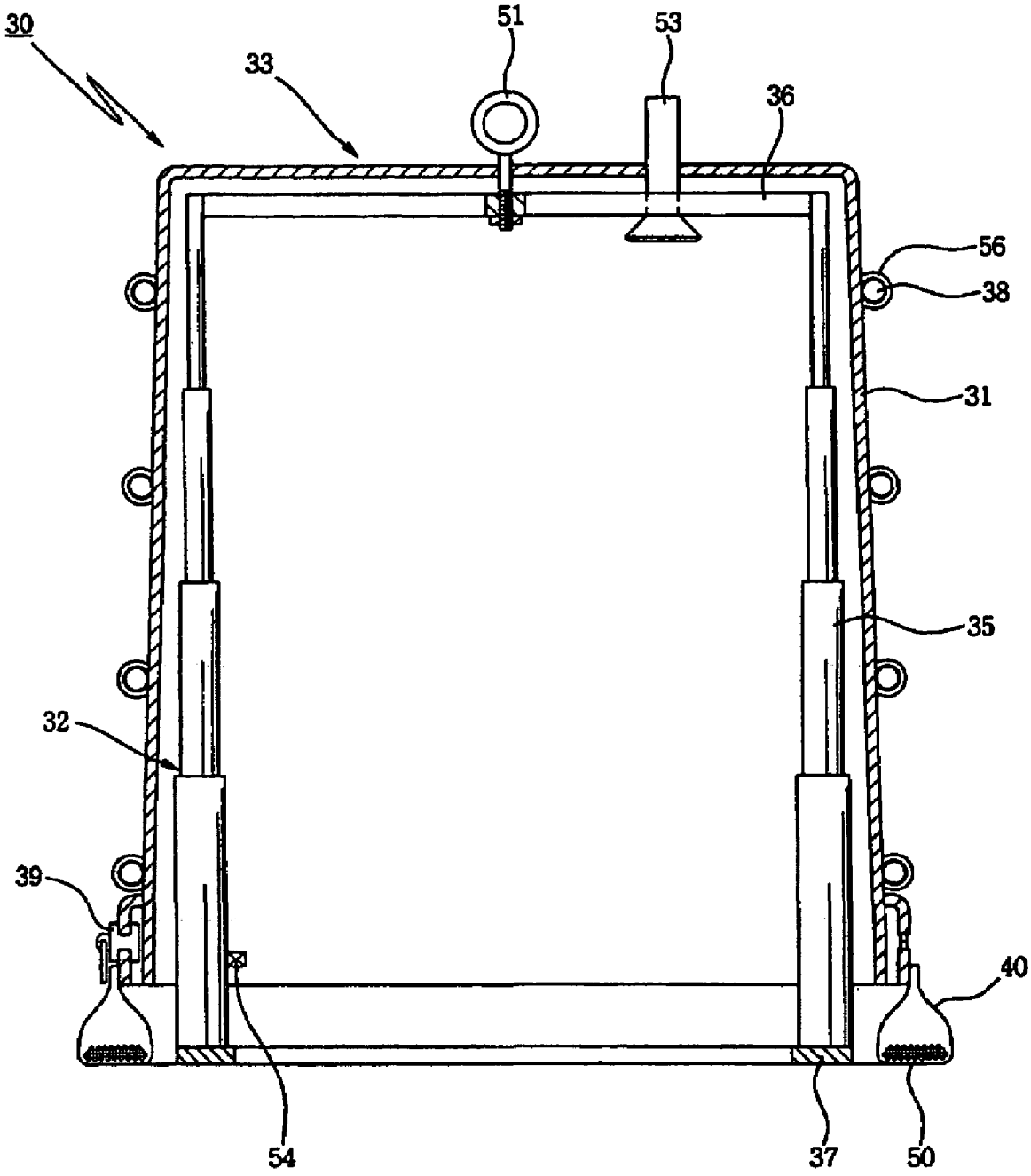
FIG. 4 is a sectional view taken along line A-A of FIG. 3.
Figure 5:
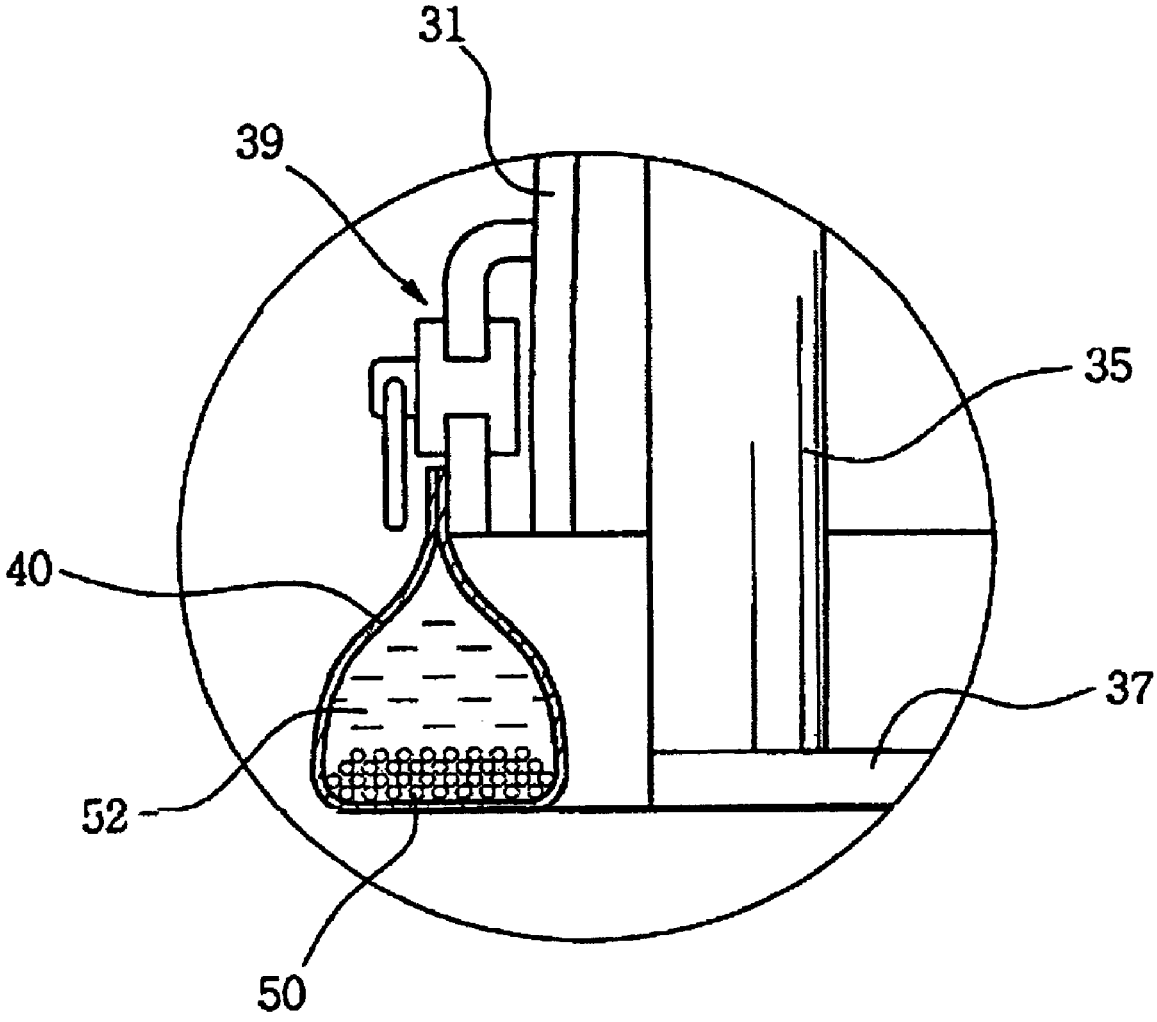
FIG. 5 is a sectional view to show important parts of the cutoff device, according to the present invention.

FIG. 4 is a sectional view taken along line A-A of FIG. 3, and FIG. 5 is an enlarged sectional view of important parts of FIG. 4. As shown in the drawings, the housing 30 is opened at a bottom thereof and supports the cover 33. The cover 33 covers an upper end of the housing 30 and is integrated with a cutoff wall 31 which is opened at a lower end thereof. The cutoff device also includes a flexible tubular liquid bag 40 which is attached to the lower end of the cutoff wall 31.

To achieve an excellent seal, a heavy substance is put into the liquid bag 40. For example, when at least one of sand, soil, and powdered or granulated metal is added to liquid, such as water or oil, a desired effect is accomplished. Of course, liquid mercury may be used as the heavy substance. In this regard, the strength of the liquid bag 40 must be considered.

The housing 30 comprises an inner frame 32, and the cover 33 which covers the exterior of the inner frame 32 except the bottom.

The inner frame 32 comprises the telescopic columns 35 whose height is adjustable, the upper support frame which is coupled to the upper ends of the telescopic column 35, and the lower support frame 37 which is coupled to the lower ends of the telescopic columns 35.

Further, the exterior of the cover 33 is supported by horizontal support bars 38 that are arranged on an outer surface of the cover 33 at regular heights and are supported by support sleeves 56.

When short columns are required, rod-shaped columns may be used in place of the telescopic columns 35.

As shown in the drawings, an upper end of the liquid bag 40 is fastened to the lower end of the cutoff wall 31 using a zipper 39. Reference numeral 51 is a ring which is provided at a position on the upper support frames 36 and is exposed to the outside of the cover 33. Although not shown in the drawings, the suction head (see, FIG. 1) or other equipment may be installed on the frames 36 and 37. Reference numeral 52 is liquid contained in the tubular liquid bag 40, for example, water or antifreeze liquid. As an example of a heavy substance 50, sand, soil, and powdered or granulated metal may be used. If metal is used as the heavy substance 50, stainless steel, which is resistant to rust, is preferred. Preferably, a sensor 54 is installed at a predetermined position on the lower ends of the telescopic columns 35, and senses whether the height adjustment of the telescopic columns 35 has been completed or not. Reference numeral 53 denotes a discharge pipe. A discharge means is omitted in the drawings.

In this invention constructed as described above, a rope or the like is fastened to the ring 51 and the cutoff device moves to a position where a seal is required. Before the cutoff device is placed at a predetermined position, as shown in FIG. 5, the lower end of the cutoff wall 31 and the tubular liquid bag 40 are fastened to each other using the zipper 39, thus supporting the liquid bag 40. Further, water or antifreeze liquid is fed into the liquid bag 40 through a valve (not shown) which is provided at a predetermined position on the liquid bag 40. At this time, water or antifreeze liquid is fed into the liquid bag 40 so that the liquid bag 40 is not tightened but is crumpled. The liquid 52 is contained in the liquid bag 40, and simultaneously, the heavy substance 50, such as granulated or powdered metal, soil, and sand is added to the liquid 52. Thereby, the liquid 52 and the heavy substance 50 strongly weigh down the bottom of the liquid bag 40, thus effectively isolating the interior of the cutoff device from the exterior. The liquid is fed into the liquid bag 40 such that the liquid bag 40 is crumpled, and the heavy substance 50 is added to the liquid, thus efficiently sealing the gap between the liquid bag 40 and a riverbed contacting the liquid bag 40, even though the riverbed is uneven.

When the cutoff device is installed and placed on a riverbed via a ship or other transport means (a sludge removal means may be separately installed or may be installed at a predetermined position on the housing), fluid laden with sludge is discharged from an interior of the cover 33 through a discharge pipe 53 to the outside by suction force from the vacuum generating unit 3 shown in FIG. 1. In this case, the upper end and side of the cover 33 are isolated from the outside by the cutoff wall 31. Simultaneously, the flexible tubular liquid bag 40 comes into close contact with the riverbed, regardless of whether the riverbed is uneven or not. Thus, the volume inside the cover 33 is reduced in proportion to the amount of fluid discharged through the discharge pipe 53. This is possible because the upper and lower support frames 36 and 37 are supported by the telescopic columns 35 according to the present invention. Since the telescopic columns 35 have the same construction as a conventional antenna, the telescopic columns 35 are compressible when being pushed and extensible when being pulled. That is, as fluid laden with sludge is discharged through the discharge pipe 53, internal pressure is increased and the length of the telescopic columns 35 is gradually reduced. In this case, as the height of the cutoff wall 31 is gradually reduced, the flexible cutoff wall 31 may be rushed into the discharge pipe 53 after passing between the telescopic columns 35 and moving the center of the cutoff device. In order to prevent this undesirable situation, the horizontal support bars 38 are arranged at regular heights. The horizontal support bars 38 function as support ribs allowing the cutoff wall 31 to be collapsed stepwise, thus preventing the cutoff wall 31 from being irregularly deformed. When the housing 30 is low, a column having a fixed length may be used in place of the telescopic columns 35.

The cutoff device of this invention may be used on the ground. In this case, the discharge pipe 53 is closed or is configured to pass through a filter. When the cutoff device of this invention is used for flooring construction work in a dusty space, the cutoff device isolates a work site from the atmosphere, thus preventing movement of dust and facilitating environmentally friendly work. Further, when the cutoff device of this invention is used for building dismantling or painting work, the cutoff device thoroughly isolates a work site from the atmosphere, thus facilitating environmentally friendly work. Meanwhile, when the bottom surface contacting the cutoff device is flat, a worker has only to feed the liquid 52 into the liquid bag without the necessity of adding the heavy substance 50 to the liquid.

INDUSTRIAL APPLICABILITY

As described above, the present invention provides a cutoff device, which is constructed so that a liquid bag serving to prevent the inflow of fluid is attached to a lower end of a cutoff wall, thus cutting off the flow of fluid.

According to the present invention, the liquid bag is attached to the lower end of the cutoff wall, thus preventing fluid from flowing in and out a housing, even when the bottom surface contacting the cutoff device is uneven.

Further, as the contents of the housing are discharged, the height of the housing becomes lower, thus completely preventing inlet pressure of fluid from acting on an interior of the cutoff device.

Furthermore, a heavy substance, such as soil, sand, or powdered or granulated metal, is added to liquid contained in a liquid bag, so that even the corners of the liquid bag are pressed against the bottom surface even though the bottom surface is uneven, thus accomplishing an excellent seal. Of course, liquid mercury may be used as the heavy substance. However, when liquid mercury is used, the liquid bag must have a double-walled structure so as to prevent the liquid bag from being broken or damaged.

The invention claimed is:

1. A cutoff device for a dredger, comprising:

a framed housing opened at a lower end thereof, and supporting a cover having a cutoff wall, the cutoff wall being opened at a lower end thereof; a discharge pipe located at an upper end of the cover;

a flexible liquid bag attached around the lower end of the cutoff wall; and wherein, the lower end of the cutoff wall is fastened around the upper end of the liquid bag using a zipper.

2. The cutoff device according to claim 1, wherein the framed housing comprises:

a telescopic column that is extensible or compressible;

an upper support frame coupled to an upper end of the telescopic column; and a lower support frame coupled to a lower end of the telescopic column.

3. The cutoff device according to claim 1, wherein an outer surface of the cutoff wall of the cover is supported by horizontal support bars that are arranged at predetermined heights.

* * * * *